US005352187A

United States Patent [19]

Tseng

[11] Patent Number: 5,352,187

[45] Date of Patent: Oct. 4, 1994

[54] HAND MASSAGER

[76] Inventor: Ton Tseng, 5F. No. 2, Lane 104, Ching Hua Street, Taipei, Taiwan

[21] Appl. No.: 156,050

[22] Filed: Nov. 23, 1993

[51] Int. Cl.[5] ..... A61H 15/00

[52] U.S. Cl. ..... 601/134; 601/121; 601/40

[58] Field of Search ..... 601/40, 107, 118, 121, 601/134, 135, 137, 136; 132/119, 121, 123, 143; 606/204

[56] References Cited

U.S. PATENT DOCUMENTS 3,368,554 8/1965 Chou ..... 132/119
3,625,204 12/1971 Sekiguchi ..... 601/134
5,143,056 9/1992 Yih-Jong ..... 601/118

*Primary Examiner*—Robert A. Hafer
*Assistant Examiner*—David J. Keneahy

[57] ABSTRACT

A hand massager includes a top shell having two upright tubes on the inside and raised portions on the outside, a bottom shell having two upright posts on the inside made to slide in the upright tubes and raised portions on the outside, a pin set retained between the top and bottom shells and supported between springs and having pins aligned with pin holes on the bottom shell, wherein the pins of the pin set project out of the pin holes on the bottom shell to stimulate the acupuncture points in the hand as the user grips the hand massager in the hand.

1 Claim, 6 Drawing Sheets

HAND MASSAGER

BACKGROUND OF THE INVENTION

The present invention relates to a hand massager which stimulates the acupuncture points in the hand as it is gripped.

It has been known that stimulating certain acupuncture points in the body or rubbing and kneading certain muscles and joints of the body can make certain part of the body work better. Various devices have been disclosed for this purpose. FIG. 1 shows a hand massager designed to massage the muscles and joints of the hand as it is gripped. This hand massager is comprised of an egg-like body having a plurality of raised portions distributed over the outside wall. However, this structure of hand massager has drawbacks. Because it is not compressible, the user will soon tire of gripping it. Further, in order to fully stimulate the acupuncture points in the hand, the position of the hand massager in the hand must be frequently changed.

SUMMARY OF THE INVENTION

The present invention has been accomplished under the aforesaid circumstances. It is therefore an object of the present invention to provide a hand massager which eliminates the aforesaid drawbacks. It is another object of the present invention to provide a hand massager which can effectively stimulate the acupuncture points in the hand. It is still another object of the present invention to provide a hand massager which attracts people to use. According to the preferred embodiment of the present invention, the hand massager comprises a top shell having two upright tubes on the inside and raised portions on the outside, a bottom shell having two upright posts on the inside made to slide in the upright tubes and raised portions on the outside, a pin set retained between the top and bottom shells and supported between springs and having pins aligned with pin holes on the bottom shell. When the hand massager is gripped in the hand, the pins of the pin set project out of the pin holes on the bottom shell to stimulate the acupuncture points in the hand, and at the same time, the raised portions on the top and bottom shells rub and knead the muscles and joints of the hand.

DETAILED DESCRIPTION OF THE PREFERRED EMBODIMENT

Figure 1:
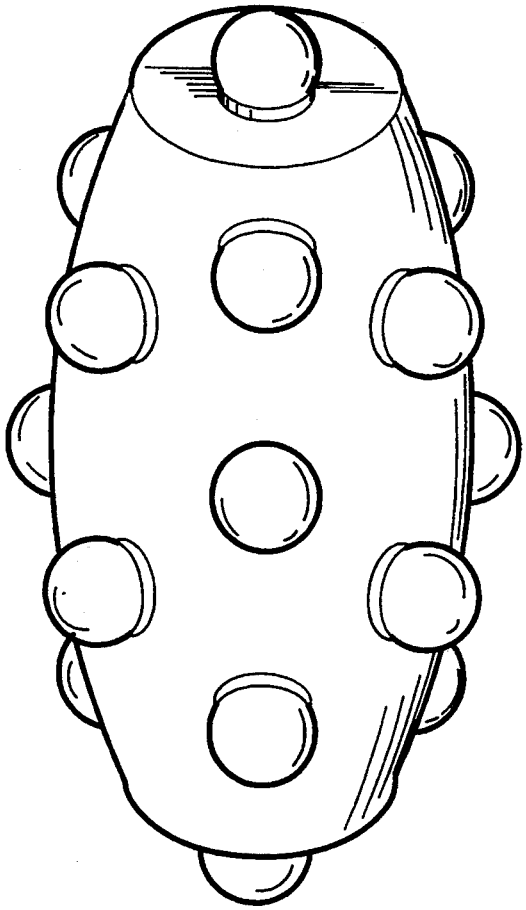
FIG. 1 is an elevational view of a hand massager according to the prior art.
Figure 2:
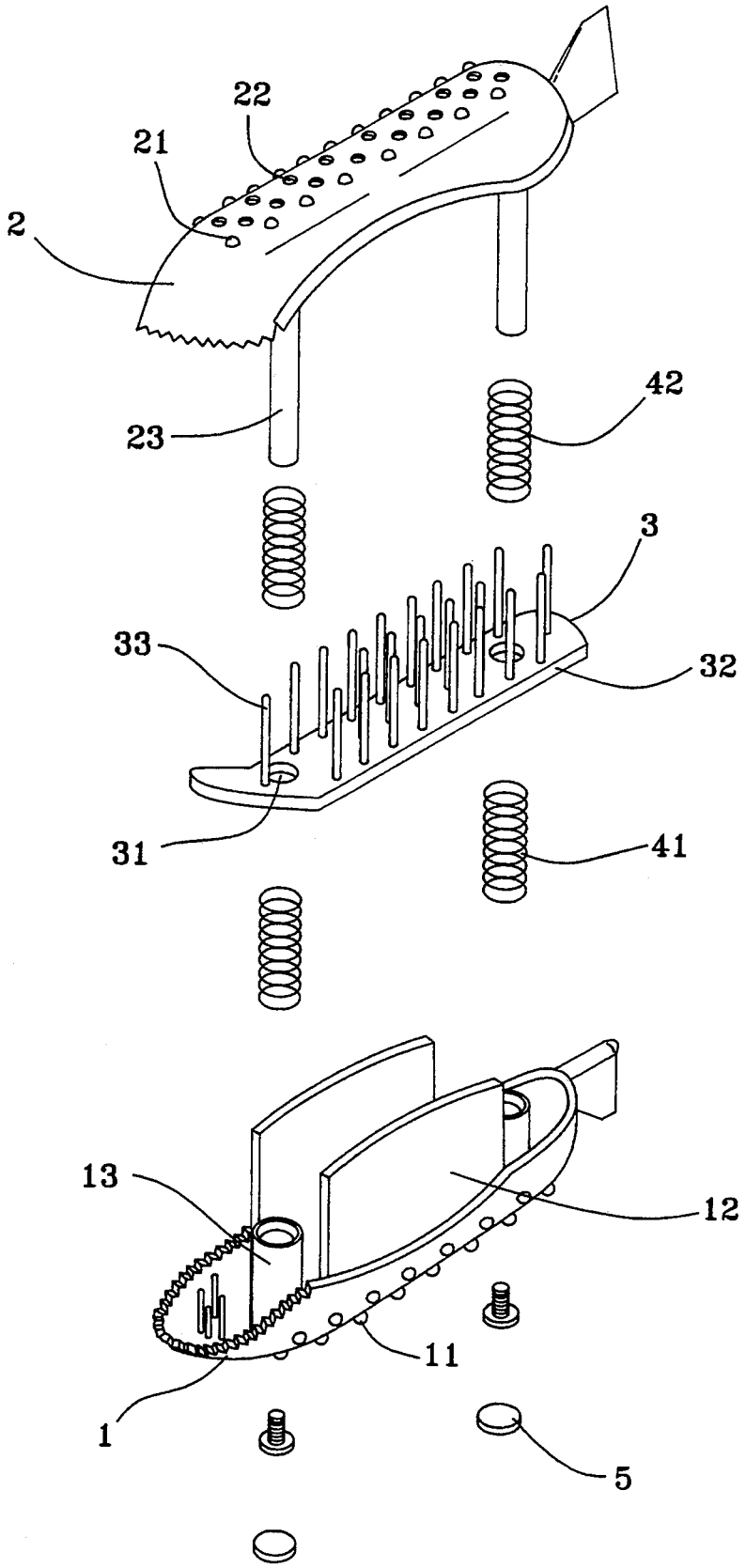
FIG. 2 is an exploded view of a hand massager according to the preferred embodiment of the present invention.
Figure 3:
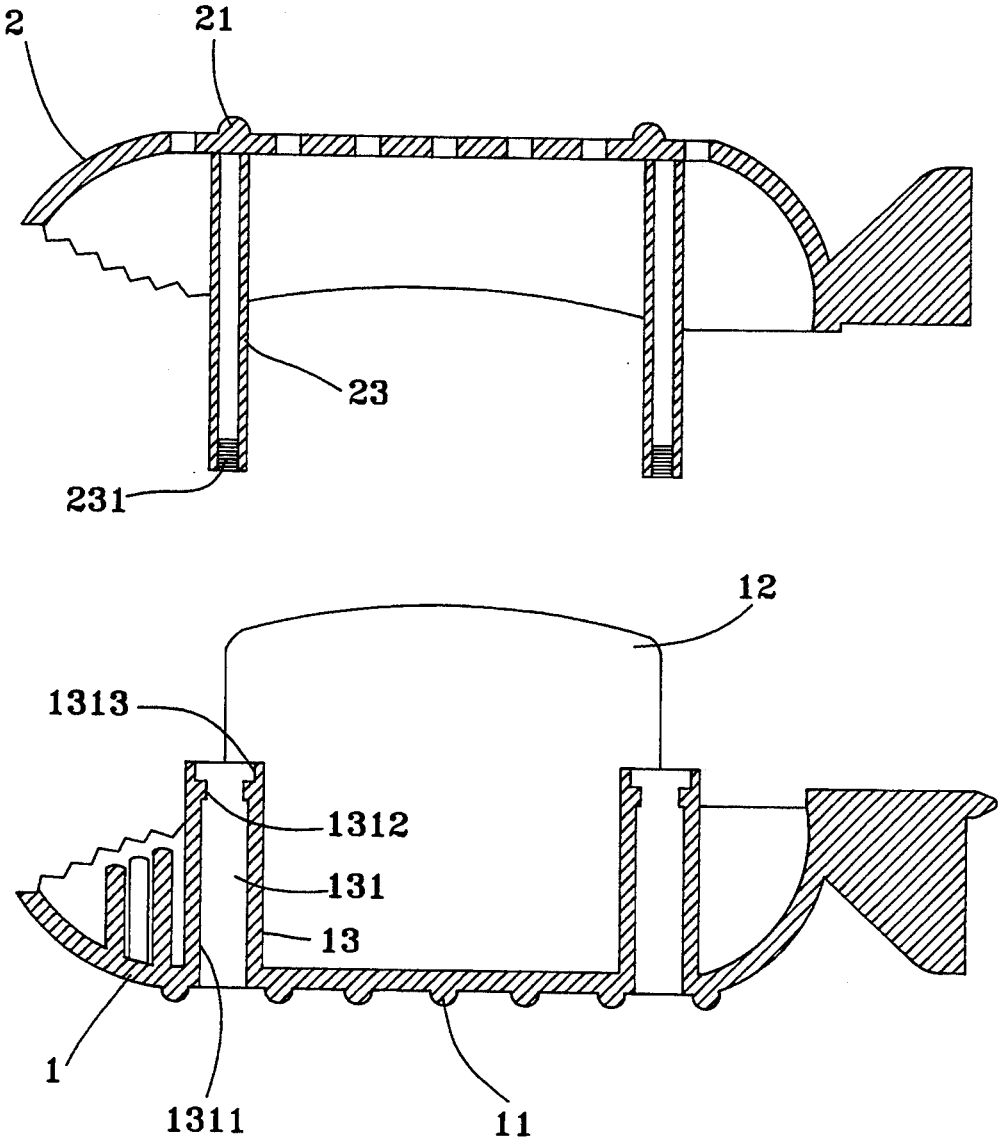
FIG. 3 is a longitudinal view in section of the top and bottom shells of the hand massager shown in FIG. 2.

Referring to FIGS. 2 and 3, a hand massager in accordance with the preferred embodiment of the present invention is generally comprised of a stop shell 1, a bottom shell 2, a pin set 3, and two pairs of compression springs 41;42. The top shell 1 is a curved, hollow, elongated shell having a plurality of raised portions 11 evenly distributed over the outside surface thereof, two parallel upright walls 12 longitudinally and bilaterally disposed on the inside, and two upright tubes 13 spaced on the inside near the two opposite ends thereof. Each upright tube 13 has an inside annular flange 1312 projecting into the respective longitudinal through hole 131, and therefore the longitudinal through hole 131 of each upright tube 13 is divided by the respective inside annular flange 1312 into an upper chamber 1311 and a lower chamber 1313. The bottom shell 2 fits over the top shell 1, comprising a plurality of raised portions 21 evenly distributed over the outside surface thereof, a plurality of pin holes 22 spaced between the raised portions 21, two upright posts 23 spaced on the inside near the two opposite ends thereof and respectively inserted into the longitudinal through hole 131. Each upright post 23 has a screw hole 231 on the respective top end. The pin set 3 comprises a thin, flat back board 32 having two round holes 31, through which the upright posts 23 pass, and a plurality of upright pins 33 respectively aligned with the through holes 22 on the bottom shell 2.

Figure 4:
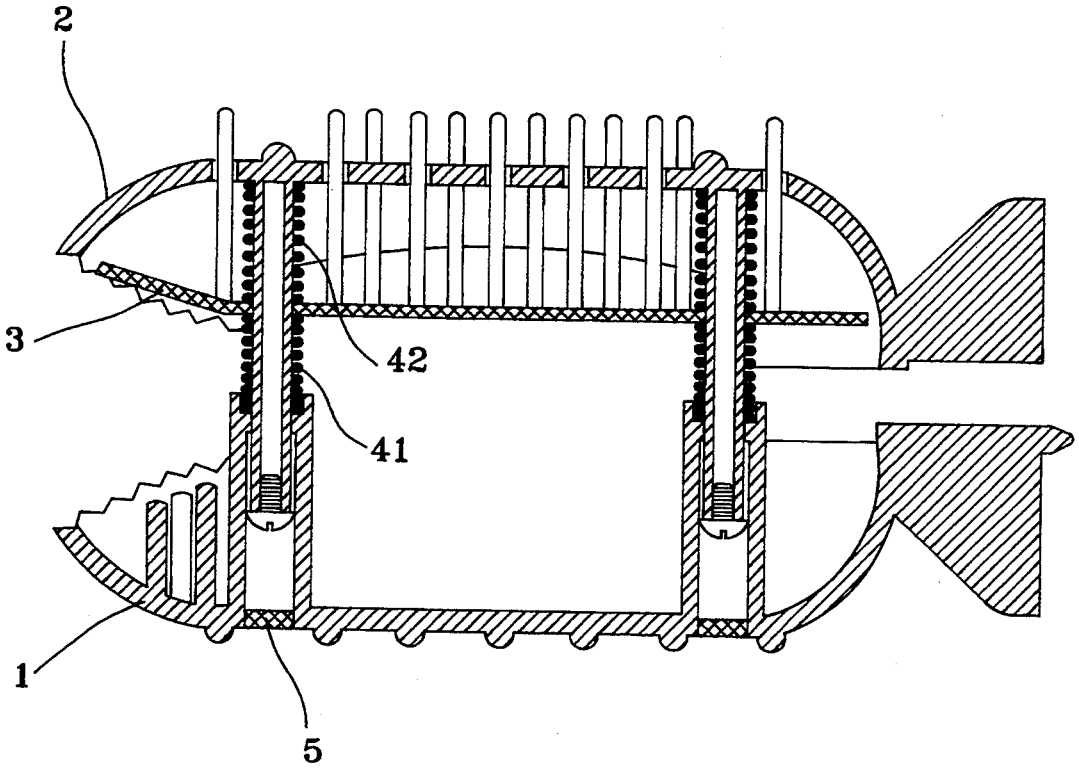
FIG. 4 is a sectional assembly view of the hand massager shown in FIG. 2.
Figure 5:
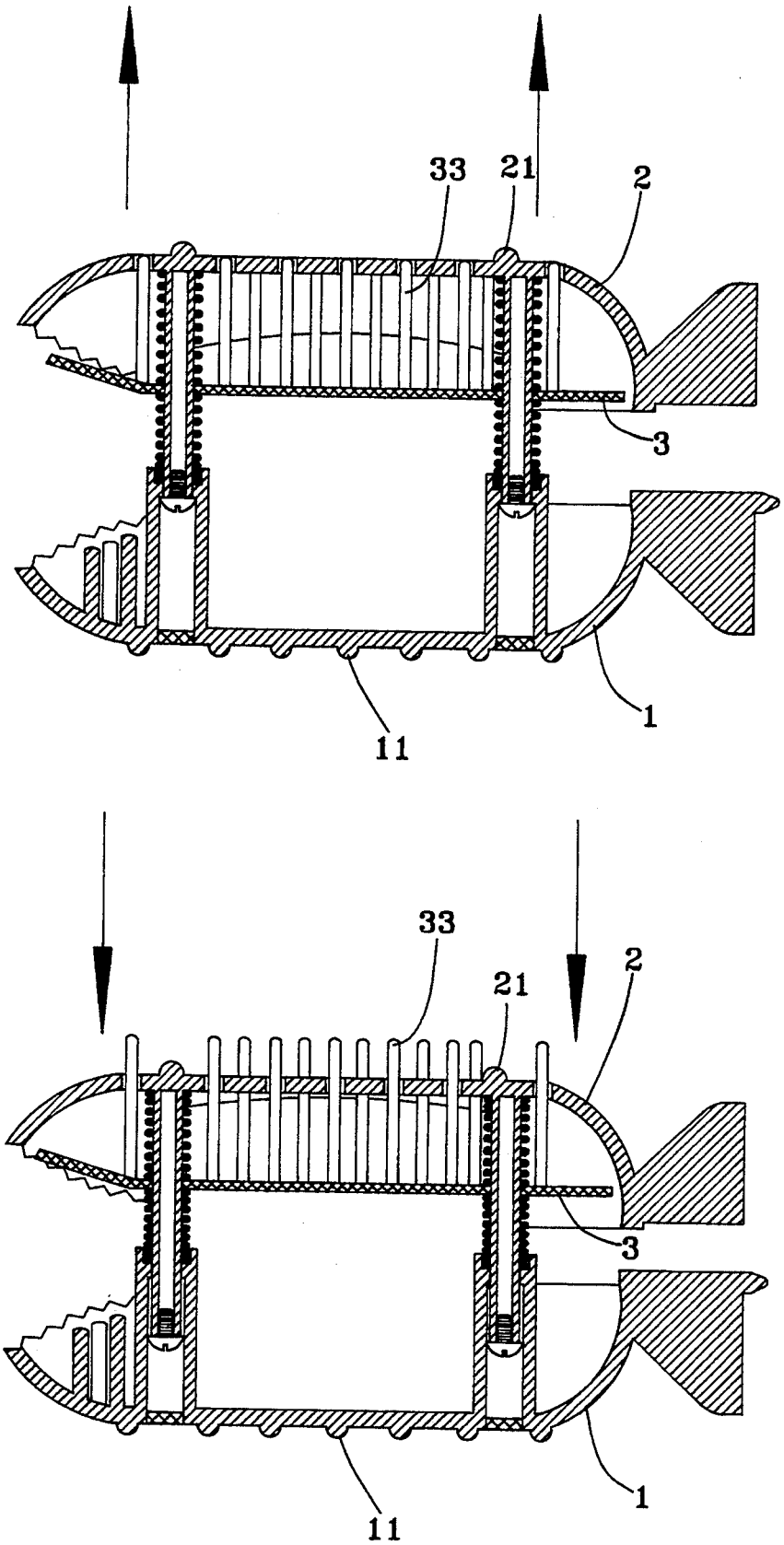
FIG. 5 shows the hand massager operated.
Figure 6:
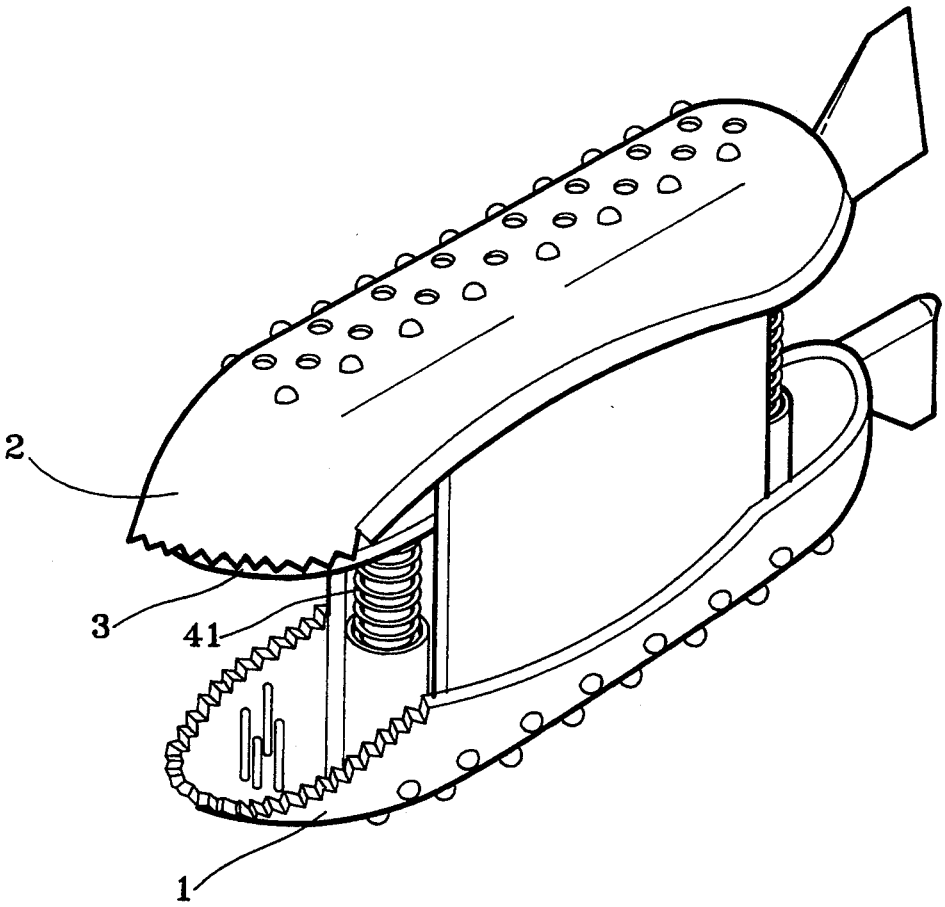
FIG. 6 is an elevational view of the hand massager of FIG. 2.

The assembly process of the present invention is easy and outlined hereinafter with reference to FIGS. 4, 5, and 6. The upright posts 23 of the bottom shell 2 are respectively inserted through a first pair of compression springs 42, the two round holes 31 on the pin set 3, and the longitudinal through holes 131 of the upright tubes 13 of the top shell 1, and then the screw hole 231 of upright post 23 is respectively screwed up with a respective screw, and then the longitudinal through holes 131 of the upright tubes 13 are respectively sealed with a respective cap 5. When assembled, the pin set 3 is protected between the upright walls 12, the compression springs 42 are mounted around the upright posts 23 and retained between the bottom shell 2 and the pin set 3, the compression springs 41 are mounted around the upright posts 23 and retained between the pin set 3 and the inside annular flange 1312 of either upright tube 13 of the top shell 13, and the head of the screw on the screw hole 231 of either upright post 23 is stopped against the inside annular flange 1312 of the respective upright tube 13, and therefore the bottom shell 2 does not disconnect from the top shell 1. As the hand massager is gripped in the hand, the top shell 1 and the bottom shell 2 are moved toward each other, as shown in FIG. 5, causing the pins 33 of the pin set 3 to project out of the through holes 22 on the bottom shell 2 in stimulating the acupuncture points in the hand. As the pressure is released from the hand massager, the compression springs 41;42 move the top and bottom shells 1;2 apart. As the top and bottom shells 1;2 have respective raised portions 11;21, the muscles and joints of the hand are simultaneously massaged when gripped.

What is claimed is:

1. A hand massager comprising:

a top shell having a plurality of raised portions evenly distributed over an outside surface thereof, two parallel upright walls longitudinally and bilaterally disposed on the inside, and two upright tubes spaced on the inside near two opposite ends thereof, each upright tube having an inside annular flange;

a bottom shell fitting over said top shell, said bottom shell comprising a plurality of raised portions evenly distributed over an outside surface thereof, a plurality of pin holes spaced between the raised portions thereof, two upright posts spaced respectively inserted into said upright tubes and moved to slide therein;

a pin set mounted around said upright posts of said bottom shell and retained between said upright walls of said top shell, said pin set comprising a flat back board having two round holes, through which said upright posts of said bottom shell pass, and a plurality of upright pins respectively aligned with and moved to extend out of the through holes on said bottom shell;

first spring means respectively mounted around said upright posts of said bottom shell and retained between said bottom shell and said pin set;

second spring means respectively mounted around said upright posts of said bottom shell and retained between said pin set and the inside annular flange of either upright tube of said top shell; and stop means respectively fastened to said upright posts to retain said upright posts in said upright tubes permitting said upright posts to be moved in said upright tubes.

* * * * *